US005390983A

United States Patent [19]

Baiden et al.

[11] Patent Number: 5,390,983

[45] Date of Patent: Feb. 21, 1995

[54] ROADBED PROFILER AND METHOD OF PROFILING

[75] Inventors: Gregory R. Baiden, Lively; Donald D. Young, Sudbury; Donald A. Desjardins, Garson, all of Canada

[73] Assignee: Inco Limited, Toronto, Canada

[21] Appl. No.: 179,470

[22] Filed: Jan. 7, 1994

[51] Int. Cl.[6] ..... E21C 25/02; E21C 25/04

[52] U.S. Cl. ..... 299/10; 299/37; 299/94

[58] Field of Search ..... 299/1.5, 10, 37, 69, 299/70, 94; 404/91, 133.05

[56] References Cited

U.S. PATENT DOCUMENTS 2,587,969 3/1952 Cornett ..... 299/37 X
4,682,819 7/1987 Masse ..... 299/10
4,940,289 7/1990 Trovato et al. ..... 299/37

FOREIGN PATENT DOCUMENTS 1064452 9/1959 Germany ..... 299/37
916195 1/1963 United Kingdom ..... 299/37

*Primary Examiner*—David J. Bagnell
*Attorney, Agent, or Firm*—Edward A. Steen

[57] ABSTRACT

A hard surface roadbed profiler designed to perform a repetitive drill hole collaring cycle. By generating a series of interconnected collar holes, an extended flat surface is created. The profiler includes a movable percussive device mounted onto a chassis. A flat faced bit is attached to the percussive device to create the individual collars that are linked together to form a flat array.

20 Claims, 6 Drawing Sheets

ROADBED PROFILER AND METHOD OF PROFILING

TECHNICAL FIELD

The instant invention relates to roadbeds in general and, more particularly to a profiling technique for producing flat hardrock roadbed surfaces in mines and other sites without the need for concrete surfacing.

BACKGROUND ART

Roadbed maintenance is an ongoing operation in all mines. Stopes, level haulage drifts, ramps etc. all must be leveled to provide an appropriate platform for operations.

With increased interest in automated, trackless mining, haulage roadways have become critical. With respect to automated transports, the tram rate is dependent upon the speed that can be attained and the load capacity of the vehicles.

Drift profiling machinery exists for soft rock mining operations, such as potash fields. However, these devices are not suitable for hardrock applications.

There is an increasing need for an apparatus that will efficiently profile a hardrock roadbed.

SUMMARY OF THE INVENTION

Accordingly, there is provided an apparatus that profiles a roadbed in hard rock. The apparatus performs a repetitive drill hole collaring cycle over an extended arc generating a regulated flat surface. A percussive device, such as a hammer or rock splitter, equipped with a flat face bottom bit and mounted on a parallelogram boom supported on a movable vehicle, swings through a predetermined arc. The percussive device carves out a circular collar. By sequentially repeating the drilling in adjacent locations a flat roadbed is produced.

PREFERRED MODE FOR CARRYING OUT THE INVENTION

Figure 1:
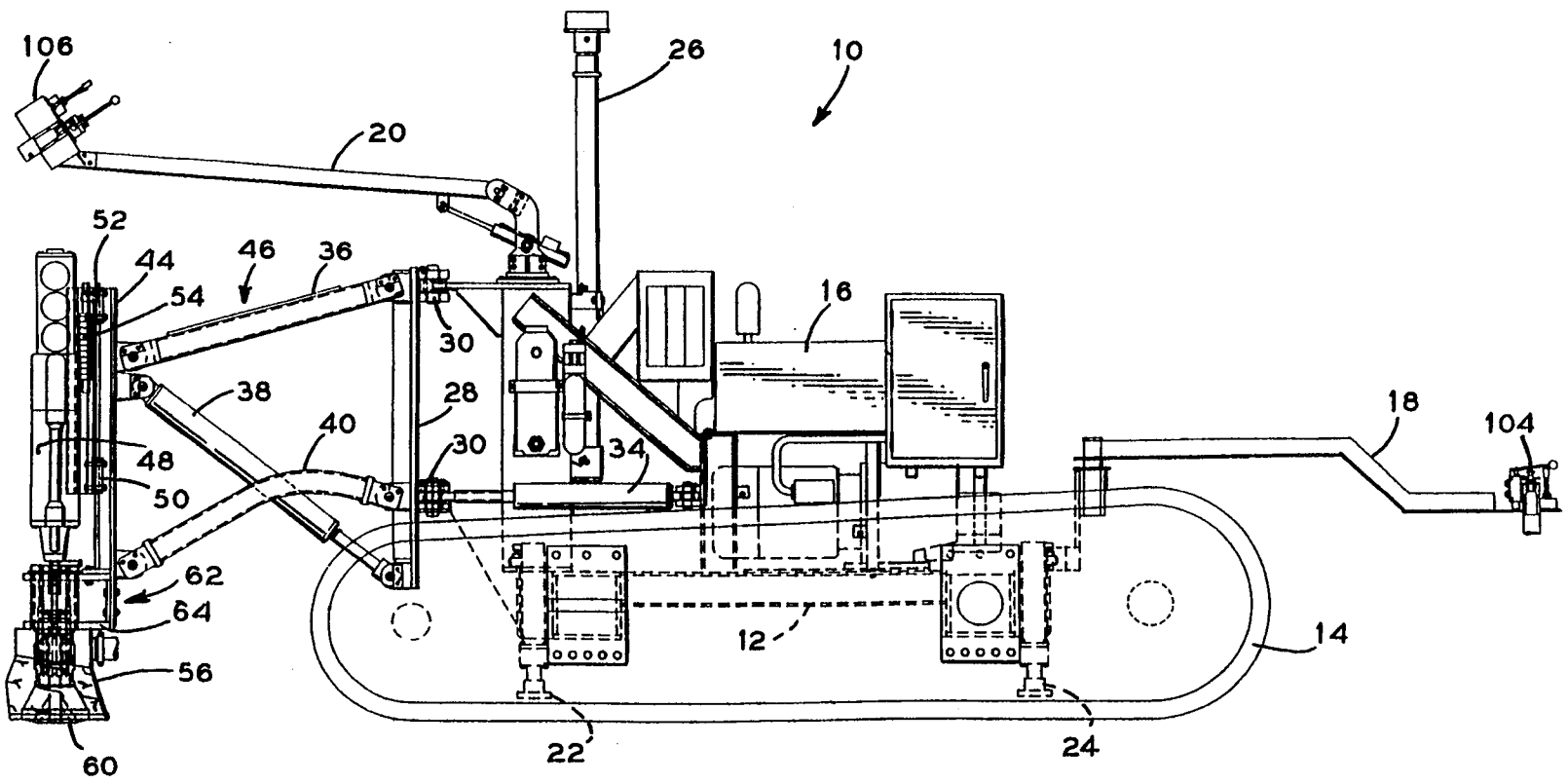
FIG. 1 is an elevation of an embodiment of the invention.
Figure 2:
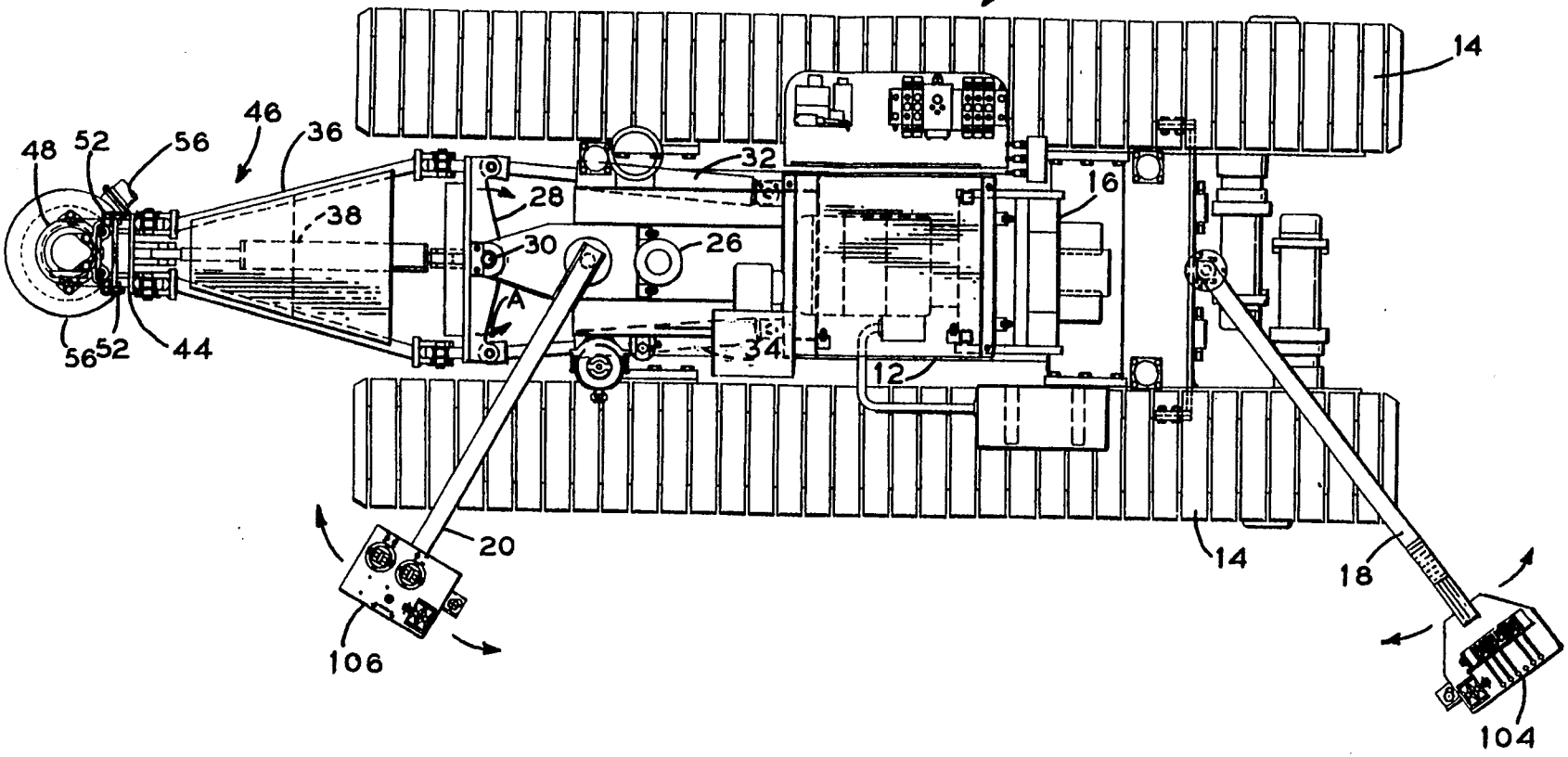
FIG. 2 is a plan view of FIG. 1.

FIGS. 1 and 2 depict a roadbed profiler 10. The profiler 10 consists of a chassis 12, endless tracks 14 for locomotion, an electrical motor or diesel engine driven hydraulic power system 16, flexible control booms 18 and 20, levelers 22 and 24, and a stinger 26. Disposed at the forward end of the chassis 12 is a rotatable support 28. Hinged at pivots 30, the support 28 is rotatable through an arc A by swing cylinders 32 and 34. Upper support bracket 36, drive cylinder 38 and arcuate support beams 40 and 42 (see FIG. 6) are pivotally hung from the support 28 and are hinged to mast 44. The upper support bracket 36, the arcuate support beams 40 and 42, the support 28, and the mast 44 form a parallelogram boom 46. The cylinder 38 raises and lowers the mast 44 and the cylinders 32 and 34 cause the mast 44 to swing. As a consequence, the mast 44 is able to sweep through a large vertically adjustable fan pattern.

A percussive device 48, such as a conventional hammer or rock splitter, is affixed to the mast 44 via a series of conventional mounting brackets. It is contemplated that either a hydraulic or a pneumatic hammer be used. It is preferred to use a hydraulic hammer since the large amount of exhaust air from a pneumatic hammer makes dust control more difficult.

In the non-limiting embodiment shown, a Montabert TM HC 120 hydraulic hammer is shown. The hammer includes a series of suspension mounting springs 54. They are available from the manufacturer and tend to dampen the cyclic vibratory motion caused by the hammering action. Rock splitters may be mounted to the mast 44 in a similar fashion known to those in the art.

A dust collector and hood 56 channel the airborne particulates and surface cuttings away from the hammer toward a blooie mounted on or near the profiler 10. A plow 58 (See FIG. 8) may be installed to assist in sweeping large debris away from the tracks 14 for subsequent clean up.

A conventional flat face bottom bit 60 is affixed to the hammer 48. Twelve inch (304.8 mm) or sixteen inch (406.4 mm) diameter flat face bits 60 are satisfactory sizes. However, depending on the circumstances any size bit may be used.

Although the hammer, bit 60 and the miscellaneous hammer mounting hardware are commercially available, a lower mounting box 62 was developed to maintain the percussive device 48 in the correct orientation vis-a-vis the mast 44.

The pivoting control boom 18 is disposed at the back or distal end of the profiler 10. A controller 104, attached to the boom 18, may be used to control the locomotion, stabilization, pressurization and related functions of the profiler 10. In this fashion, the operator may walk along aside the profiler 10 or behind it ensuring safe operation.

The forward boom 20, affixed to the proximal or front end of the chassis 12, is adapted to swing in the horizontal and vertical planes. A controller 106, mounted on the boom 20, swings away from the "business end" of the profiler 10 to enable the operator to safely control the orientation and operation of the percussive device from either side of the profiler 10 after the profiler 10 is in place. By selectively positioning the cylinders 34, 36 and 38, the parallelogram boom 46 may be oriented in three dimensions to collar the ground where needed.

It is preferred to employ arcuate support beams 40 and 42. The curve in the beam clears the front of the tracks 14 when the mast 44 is lowered.

Figure 3:
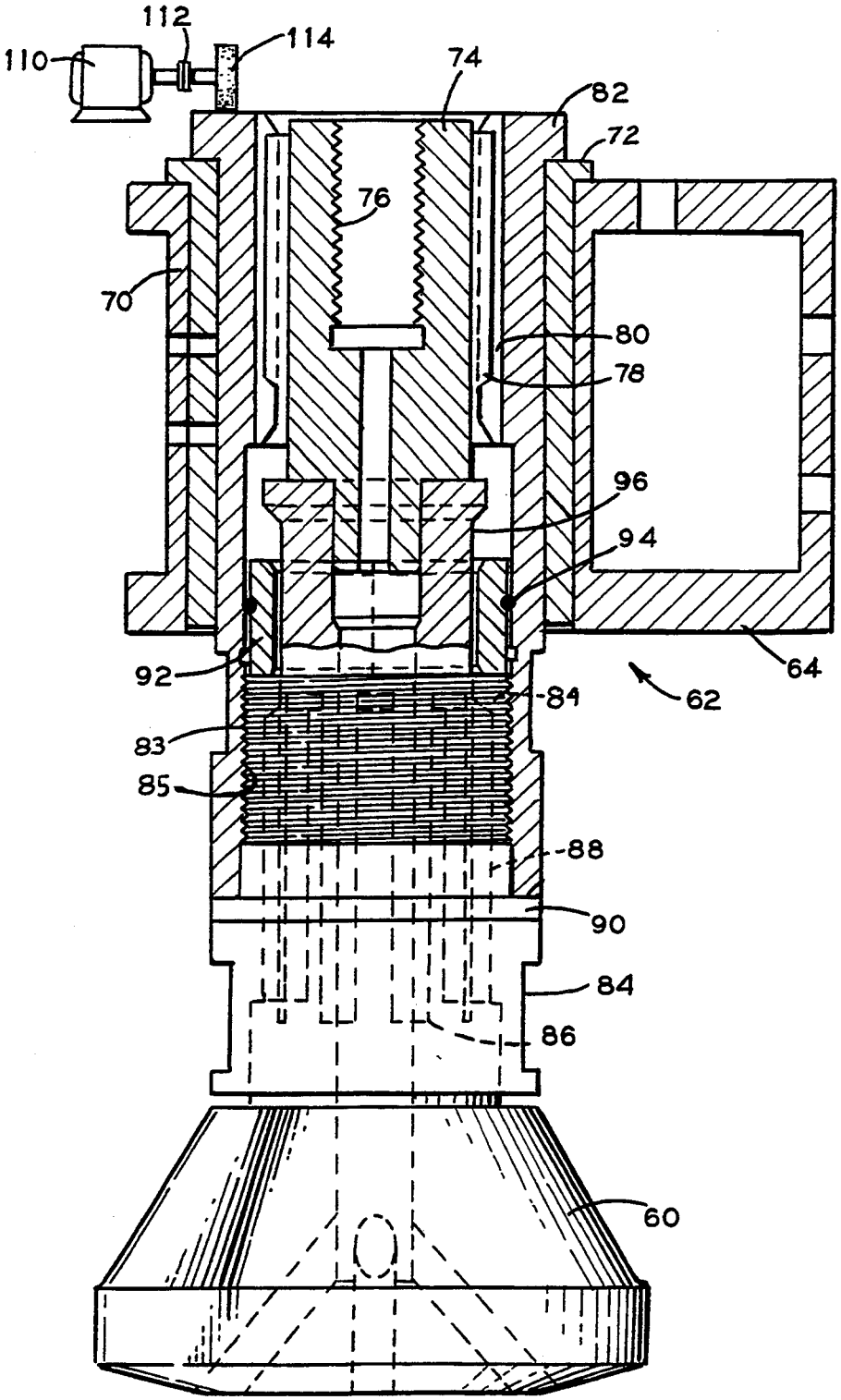
FIG. 3 is a cross-sectional view of an embodiment of the invention.
Figure 4:
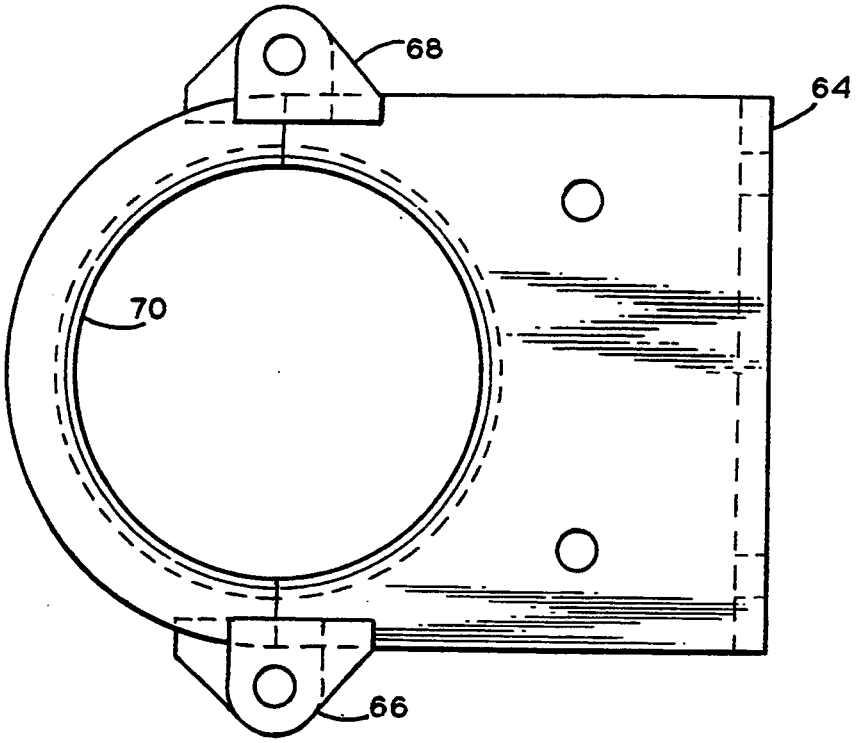
FIG. 4 is a plan view of an embodiment of the invention.
Figure 5:
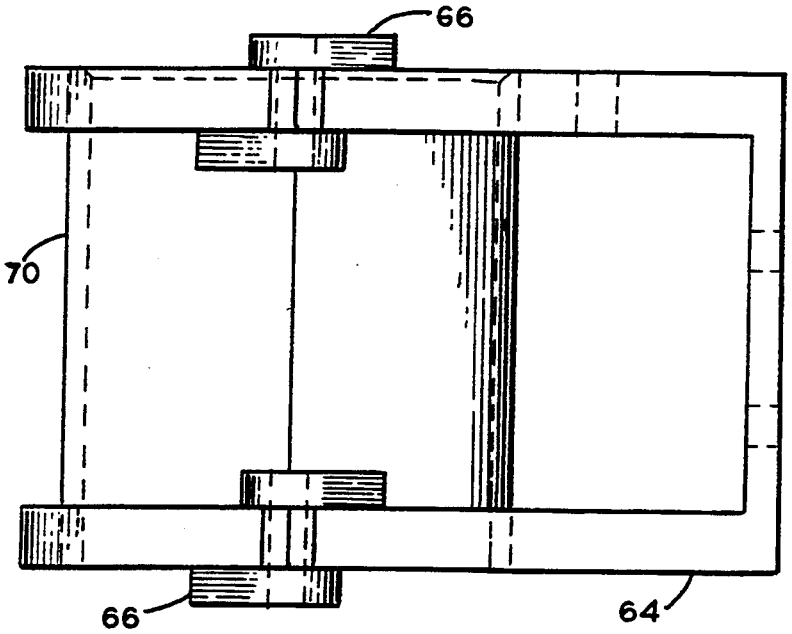
FIG. 5 is an elevation of FIG. 4.

As shown in FIG. 3, 4, and 5, the mounting box 62 includes a split work table 64 adapted to be mounted to the mast 44. The split work table 64 is provided with two hinges 66 and 68 so as to allow a saddle 70 to be separated from the remainder of the split work table 64. Bolts or pins (not shown) are inserted into the hinge 66 and 68. In order to remove the hammer 60, a bolt is removed from either of hinges 66 and 68 to allow the saddle 70 to swing away. Access to the bit 60 and the remainder of the mounting box 62 components is then readily accomplished.

Returning to FIG. 3, a split centralizer bushing 72, composed of two halves and held together by a key dowel (as shown), remains fixed within the work table 64.

The impact bar of the percussive device 48 is threaded into splined rope coupling 74. The coupling 74 includes an internal threaded cavity 76 adapted to receive the stem (not shown) of the percussive device 48. A series of splines 78 on the coupling 74 mate with corresponding splines 80 on adapter tube 82. The adaptor tube 82 is partially threaded at 83.

The bit 60 is fitted into lower sub 84. The lower sub 84 includes threads 85. A series of alternating splines 86 and 88 on the bit 60 and the bottom sub 84 interlock the bit 60 to the sub 84. A spacer ring 90 is interposed between the bottom sub 84 and the adaptor tube 82.

A split collar retaining ring 92 maintains the bit 60 in position within the adaptor tube 82. An elastic band 94 holds the ring 92 together.

In order to assemble the bit 60 to the mounting box 62, the bit 60 is inserted into the bottom sub 84 so that the neck 96 of the bit 60 extends beyond the sub 84. The split retaining ring 92, held together by the band 94, is assembled about the neck 96. Then the sub 84 is threaded into the adaptor tube 82. The threads 83 and 85 mate together. The ring 92 prevents the bit 60 from falling out of the adaptor tube 82.

During operations, if a hammer is used, the hammer's reciprocating and rotational action is transmitted through the splined rope coupling 74 directly against the bit 60. The adaptor tube 82 and all the components contained therein rotate when driven by the hammer.

Figure 6:
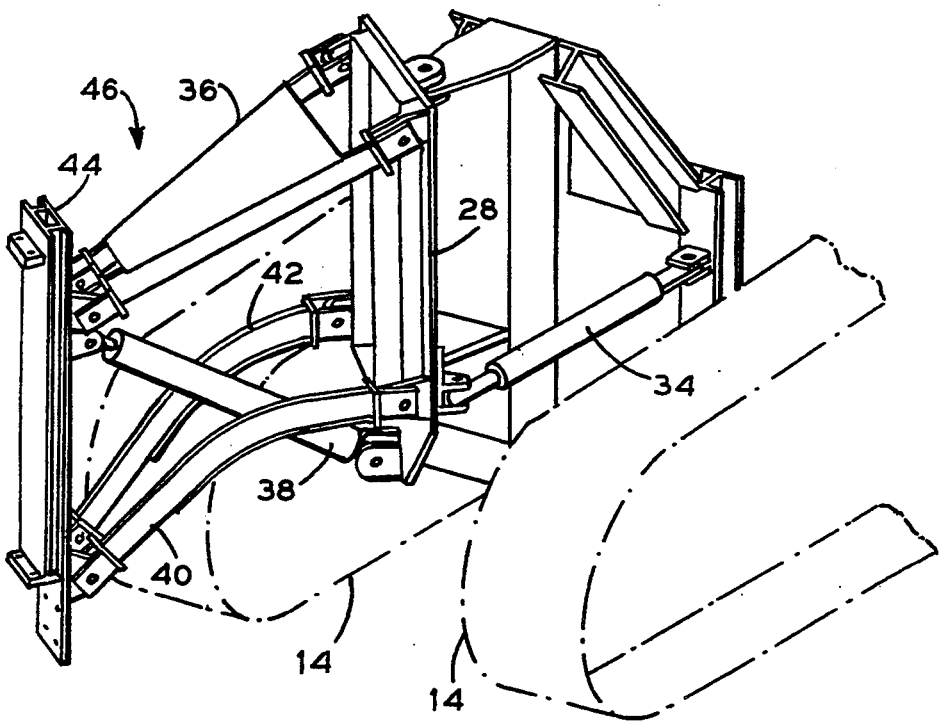
FIG. 6 is a perspective view of an embodiment of the invention.

FIG. 6 shows the proximal end of the profiler 10 in somewhat greater detail.

Figure 7:
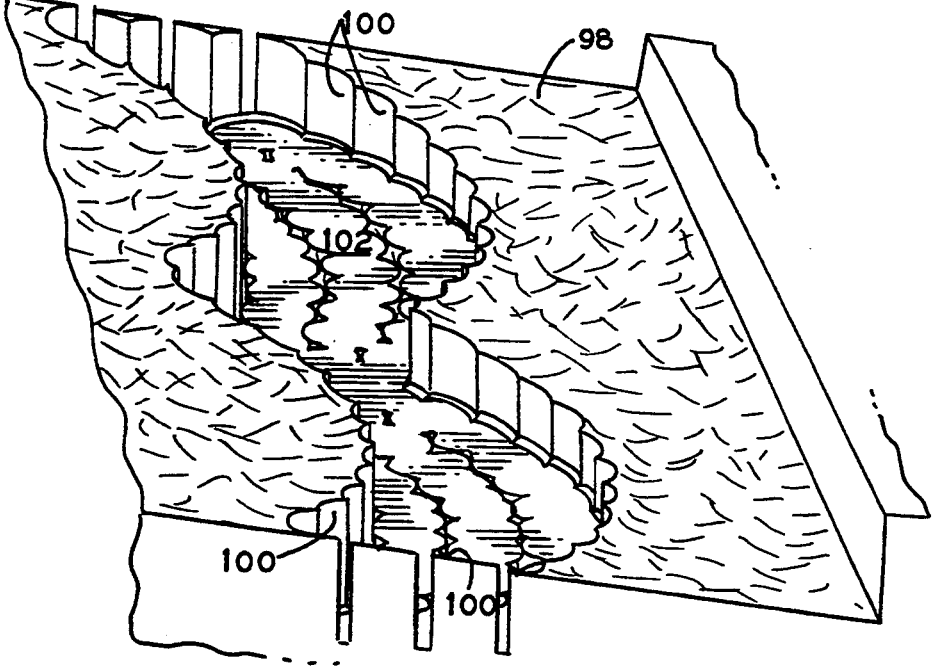
FIG. 7 is a perspective view of a partially profiled roadbed.
Figure 8:
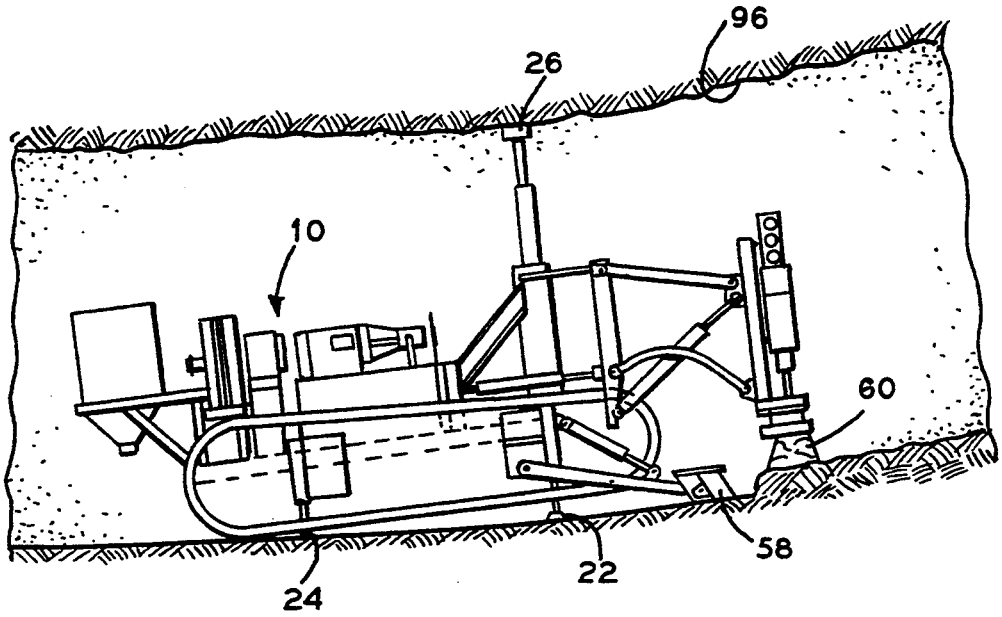
FIG. 8 depicts an embodiment of the invention on a curved surface.

FIGS. 7 and 8 represent the action of the profiler 10. The profiler 10 is transported to the location to be surfaced. The levelers 20 and 22 are placed in the appropriate position and the stinger 26 may be extended up to the back 96 of the excavation. In the event of underground roof ducts and pipes, a counterweight may be used in place of or in conjunction with the stinger 26.

FIG. 7 depicts a relatively flat but rough stretch of drift floor 98. The profiler 10 performs a repetitive drill hole collaring cycle with the depth of the collar 100 controlled on each stroke producing an extended flat surface 102. The profiled surface 102 is made by indexing the hammer 48 through an arc half the width of the drift 98. After one collar 100 is made, the hammer 48 is shifted approximating the diameter of the bit 60 and another hole is collared. Each collar 100 is slightly overlapped to cut a continuous floor 102. After the arc of cutting has been completed on one half of the drift 98, the process may be initiated on the other half of the drift 98 so as to roughly form the twin arced collar sets 100 and resulting floor 102 combination.

Upon completion of these series of cuts, the profiler 10 is advanced a distance approximately the diameter of the bit 60 and the collaring process is initiated again.

FIG. 8 depicts the profiler 10 on a vertically curved surface. In this instance, the appropriate levelers 22 and 24 would be extended. In the embodiment shown the forward leveler 22 would be substantially extended where the rear leveler 24 would be partially extended. Where the curve extends downwardly or is leveling off, the rear leveler 24 would generally be extended further than the front leveler 22. In most situations, the stinger 26 would be extended up to the back of the drift 96.

The profiler 10 easily lends itself to automation. It is envisioned that to make the first flat section at the beginning of the drift, manual control would be used. The levelers 22 and 24 would be adjusted to hold the chassis 12 level for each sweep until the crawlers 14 have a flat pad big enough to work from.

For the bulk of the remaining work on straights and curves of constant grade, the profiler 10 would cycle automatically, with controlled steering and cutting depth. An automated guidance system could be used. Transducers on the mast 44 would transmit drill angle and depth to a hydraulic servo system which is part of the broader power source 16. The stinger 26 will hold the machine for each sweep.

Vertical curves require a preset program to accommodate a change in drill angle and cutting depth for each sweep across the path. Radius of the vertical curve and change of grade would be the input parameters to a controller.

On a new underground development, the profiler 10 would keep up with the heading advance. Because there is no concrete setting time involved, the profiler 10 allows the normal development work cycle to continue unimpeded. Thus the drift is finished without the time delay to pour concrete, and this brings the investment into production sooner.

An initial test was performed at Inco Limited's North Mine, 2600 foot (792 m) level in Copper Cliff, Ontario. A series of 12 inch (304.5 mm) diameter overlapping holes were drilled 12 to 16 inches (304.5 to 406.4 mm) deep. The resulting surface was acceptably smooth at each bit face with little or no evidence of cracks below the drilling depth.

Although the roadbed profiler 10 has been designed for underground mining applications, it should be appreciated that the profiler 10 lends itself to surface or subsurface (open pit) level flattening applications as well.

In order to obtain increased drilling power, an alternative percussive device may be utilized. A hydraulic rock splitter may be substituted for a hammer. In contrast to hammers, hydraulic rock splitters do not rotate the impact bar that strikes the bit. Rather, they are analogous to the common hand operated pneumatic jack hammers commonly seen at construction sites; the main difference being that they are bigger by several orders of magnitude.

Since conventional rock splitters do not rotate, an external rotary drive 110 may be connected to the adaptor tube 82. See FIG. 3. A suitable arrangement 114 such as a gear train or a band translates the rotary movement of the drive 110 through a coupling 112 to the adaptor tube 82. The drive 110 may be affixed to the mast 44 or other suitable location.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A roadbed profiler, the roadbed profiler comprising a chassis, means for locomoting the chassis, means for providing power to the profiler, means for controlling and operating the profiler, a single percussive device associated with the chassis, a parallelogram boom affixed to the chassis, the percussive device affixed to the parallelogram boom, means for positioning the percussive device, and a flat faced bit extending from the percussive device.

2. The roadbed profiler according to claim 1 wherein the parallelogram boom includes a vertical support pivotally affixed to the chassis, a mast, a support bracket pivotally affixed to the vertical support and the mast, a support beam pivotally affixed to the vertical support and the mast, and means for displacing the parallelogram boom.

3. The roadbed profiler according to claim 2 wherein the support beam is curved.

4. The roadbed profiler according to claim 1 including a plow affixed to the chassis independent of the percussive device.

5. The roadbed profiler according to claim 1 wherein the bit is supported by a mounting box affixed to the mast.

6. The roadbed profiler according to claim 5 wherein the mounting box includes a split work table, the split work table circumscribing the bit and adapted to swing open to allow access to the bit.

7. The roadbed profiler according to claim 6 wherein a split centralizer bushing is disposed between the split work table and the bit.

8. The roadbed profiler according to claim 7 wherein the bit is disposed within a sub, the sub affixed to an adaptor tube circumscribed by the split centralizer bushing, a split retaining ring circumscribing the bit, the percussive device connected to a splined rope turned coupling, and the splined rope thread coupling communicating with the bit.

9. The roadbed profiler according to claim 1 wherein the percussive device is a hammer.

10. The roadbed profiler according to claim 1 including means for rotating the percussive device.

11. The roadbed profiler according to claim 1 wherein the percussive device is a rock splitter.

12. The roadbed profiler according to claim 1 disposed in an underground excavation and the bit successively collaring individual adjacent cuts to form a substantially continuous flat surface.

13. The roadbed profiler according to claim 1 including means for removing dust and debris from the bit.

14. The roadbed profiler according to claim 1 wherein the flat faced bit has a diameter of at least twelve inches.

15. A method for profiling a flat surface, the method comprising:

a) placing a roadbed profiler upon the surface to be profiled, the roadbed profiler including a percussive device and a flat faced drill bit, b) causing the drill bit to collar a first hole, c) moving the drill bit to an adjacent, contiguous location and collaring a second hole, the first and second holes forming an overlapped continuous void having a substantially flat bottom surface, and d) repeating steps b) and c).

16. The method according to claim 15 wherein the drill bit is moved along an arc forming successive collared holes.

17. The method according to claim 16 where upon completion of at least one collared hole, the roadbed profiler is advanced or retreated to commence drilling an adjacent collared hole.

18. The method according to claim 15 wherein cuttings from the collared hole are removed from the vicinity of the bit.

19. The method according to claim 15 wherein the roadbed profiler is disposed in a drift, the roadbed profiler collaring a first set of a plurality of overlapping holes on one half of the drift and collaring a second set of a plurality of overlapping holes on the other half of the drift, and the two sets of holes forming a continuous array of holes.

20. The method according to claim 15 including forming a relatively flat floor.

* * * * *